US006877403B2

(12) United States Patent
Hsien

(10) Patent No.: US 6,877,403 B2
(45) Date of Patent: Apr. 12, 2005

(54) TELESCOPIC SOCKET ASSEMBLY

(76) Inventor: Chih-Ching Hsien, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/634,183

(22) Filed: Jul. 30, 2003

(65) Prior Publication Data

US 2005/0022632 A1 Feb. 3, 2005

(51) Int. Cl.[7] ..... B25B 13/06
(52) U.S. Cl. ..... 81/124.5; 81/124.7
(58) Field of Search ..... 81/124.3, 124.4, 81/124.5, 124.6, 124.7, 125.1, 177.2, 177.85

(56) References Cited

U.S. PATENT DOCUMENTS 1,323,056 A * 11/1919 Hofmann ..... 81/124.5
1,539,136 A * 5/1925 Beard ..... 81/124.5
1,619,255 A * 3/1927 Haynes ..... 81/124.5
3,227,015 A * 1/1966 Tremblay ..... 81/177.2
3,779,105 A * 12/1973 Triplett et al. ..... 81/124.5
4,070,932 A * 1/1978 Jeannotte ..... 81/177.2
5,163,344 A * 11/1992 Mathers ..... 81/124.5
5,251,520 A * 10/1993 Lanham ..... 81/124.5

* cited by examiner

*Primary Examiner*—Debra S. Meislin

(57) ABSTRACT

A telescopic socket assembly includes an outer socket, an inner socket retractably and movably mounted in the outer socket, and an elastic member mounted between the inner socket and the outer socket. Thus, the telescopic socket assembly has an adjustable length and can be used to operate workpieces having different sizes. In addition, the telescopic socket assembly has a two-stage or three-stage position adjustment function.

16 Claims, 8 Drawing Sheets

TELESCOPIC SOCKET ASSEMBLY

BACKGROUND OF THE INVENTION

1. Field of the Invention

The present invention relates to a telescopic socket assembly, and more particularly to a telescopic socket assembly having an adjustable length.

2. Description of the Related Art

A conventional socket comprises a cylindrical body having a first end formed with a square hole to received the driving stud of a wrench, and a second end formed with a hexagonal hole to receive a workpiece, such as a nut. Thus, the wrench can co-operate with the socket to operated and rotate the workpiece. However, the socket has a fixed size so that the conventional socket is only available for a wrench having a fixed size and cannot fit a wrench having a different size, thereby limiting the versatility of the socket.

SUMMARY OF THE INVENTION

The primary objective of the present invention is to provide a telescopic socket assembly that has a two-stage position adjustment function.

Another objective of the present invention is to provide a telescopic socket assembly that has a three-stage position adjustment function.

A further objective of the present invention is to provide a telescopic socket assembly that has an adjustable length.

A further objective of the present invention is to provide a telescopic socket assembly that can be used to operate workpieces having two different sizes.

In accordance with the present invention, there is provided a telescopic socket assembly, comprising:

an outer socket;

an inner socket retractably and movably mounted in the outer socket; and an elastic member mounted between the inner socket and the outer socket.

Further benefits and advantages of the present invention will become apparent after a careful reading of the detailed description with appropriate reference to the accompanying drawings.

DETAILED DESCRIPTION OF THE INVENTION

Figure 1:
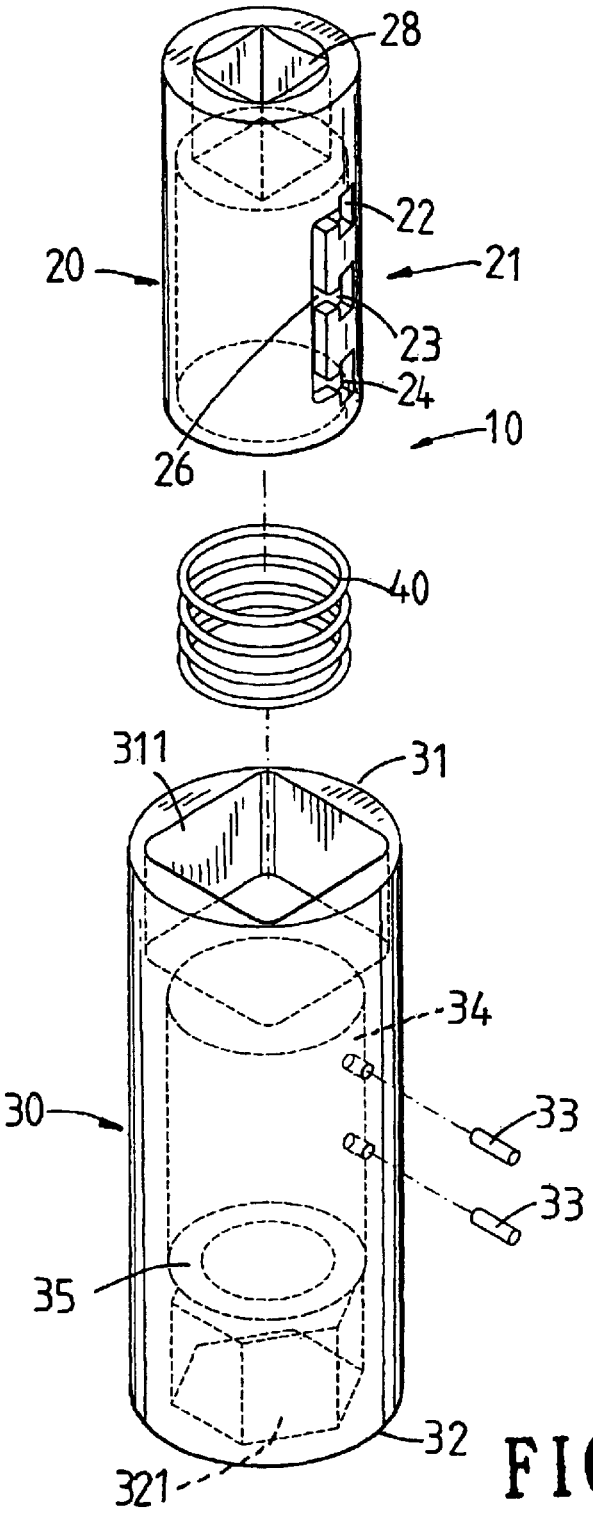
FIG. 1 is an exploded perspective view of a telescopic socket assembly in accordance with the preferred embodiment of the present invention.

Referring to the drawings and initially to FIGS. 1–4, a telescopic socket assembly in accordance with the preferred embodiment of the present invention comprises an outer socket 30, an inner socket 20 retractably and movably mounted in the outer socket 30, and an elastic member 40 mounted between the inner socket 20 and the outer socket 30.

The outer socket 30 has a first end 31 formed with a square fixing hole 311, a second end 32 formed with a hexagonal locking hole 321 and a mediate portion formed with a cylindrical receiving hole 34. The mediate portion of the outer socket 30 is provided with a shoulder 35 located adjacent to the second end 32 of the outer socket 30. The outer socket 30 has a peripheral wall provided with two spaced fixing pins 33 each extended into the receiving hole 34 of the outer socket 30.

The inner socket 20 is slidably mounted in the receiving hole 34 of the outer socket 30 and has a first end protruded outward from the first end 31 of the outer socket 30 and formed with a square fixing hole 28. The inner socket 20 has a peripheral wall formed with a substantially E-shaped adjusting hole 21 communicating with an inside of the inner socket 20.

The adjusting hole 21 of the inner socket 20 includes a longitudinally extended guide slot 26, a first positioning slot 22 communicating with the guide slot 26, a second positioning slot 23 communicating with the guide slot 26, and a third positioning slot 24 communicating with the guide slot 26.

The first positioning slot 22 of the adjusting hole 21 of the inner socket 20 is substantially T-shaped and has an upper end 2211, a lower end 2212, and a mediate portion 2214 connected to the upper end 2211 and the lower end 2212 and communicating with the guide slot 26.

The second positioning slot 23 of the adjusting hole 21 of the inner socket 20 is substantially T-shaped and has an upper end 2311, a lower end 2312, and a mediate portion 2314 connected to the upper end 2311 and the lower end 2312 and communicating with the guide slot 26.

The third positioning slot 24 of the adjusting hole 21 of the inner socket 20 is substantially T-shaped and has an upper end 2411, a lower end 2412, and a mediate portion 2414 connected to the upper end 2411 and the lower end 2412 and communicating with the guide slot 26.

In addition, the two spaced fixing pins 33 of the outer socket 30 are mounted in the adjusting hole 21 of the inner socket 20. Thus, when the inner socket 20 is moved in the receiving hole 34 of the outer socket 30, the two spaced fixing pins 33 of the outer socket 30 are moved in the adjusting hole 21 of the inner socket 20 relatively. Preferably, the two fixing pins 33 of the outer socket 30 are movably mounted in the guide slot 26 of the adjusting hole 21 of the inner socket 20 and are positioned in either two of the first positioning slot 22, the second positioning slot 23 and the third positioning slot 24 of the adjusting hole 21 of the inner socket 20.

The elastic member 40 is mounted in the receiving hole 34 of the outer socket 30 and has a first end urged on a second end of the inner socket 20 and a second end urged on the shoulder 35 of the outer socket 30.

Figure 2:
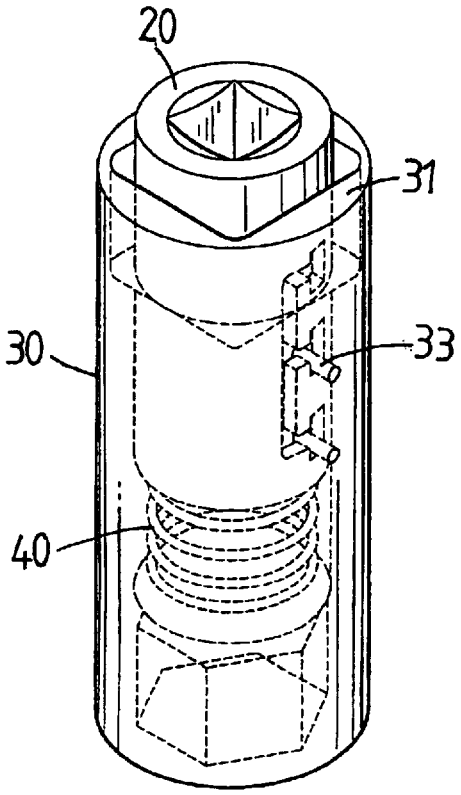
FIG. 2 is a perspective assembly view of the telescopic socket assembly as shown in FIG. 1.
Figure 4:
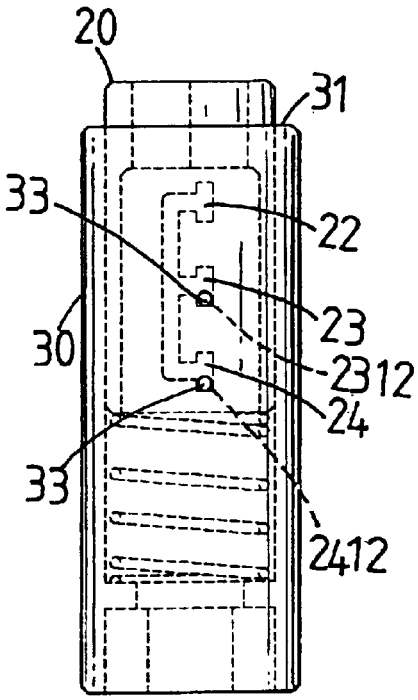
FIG. 4 is a plan view of the telescopic socket assembly as shown in FIG. 2.

In operation, as shown in FIGS. 2 and 4, the two fixing pins 33 of the outer socket 30 are initially mounted in the second positioning slot 23 and the third positioning slot 24 of the adjusting hole 21 of the inner socket 20, and are rested on the lower end 2312 of the second positioning slot 23 and the lower end 2412 of the third positioning slot 24 by the elastic force of the elastic member 40, so that the inner socket 20 is fixed in the outer socket 30 and the first end of the inner socket 20 is protruded outward from the first end 31 of the outer socket 30.

Figure 4A:
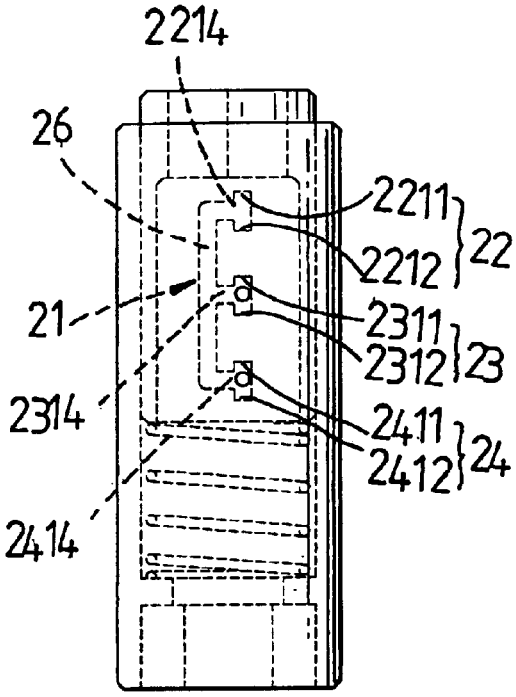
FIG. 4A is a schematic operational view of the telescopic socket assembly as shown in FIG. 4.

Then, the inner socket 20 is pressed downward to move from the position as shown in FIG. 4 to the position as shown in FIG. 4A, so that the two fixing pins 33 of the outer socket 30 are detached from the lower end 2312 of the second positioning slot 23 and the lower end 2412 of the third positioning slot 24 and are aligned with the guide slot 26 of the adjusting hole 21 of the inner socket 20.

Figures 4B, 4C, 4D:
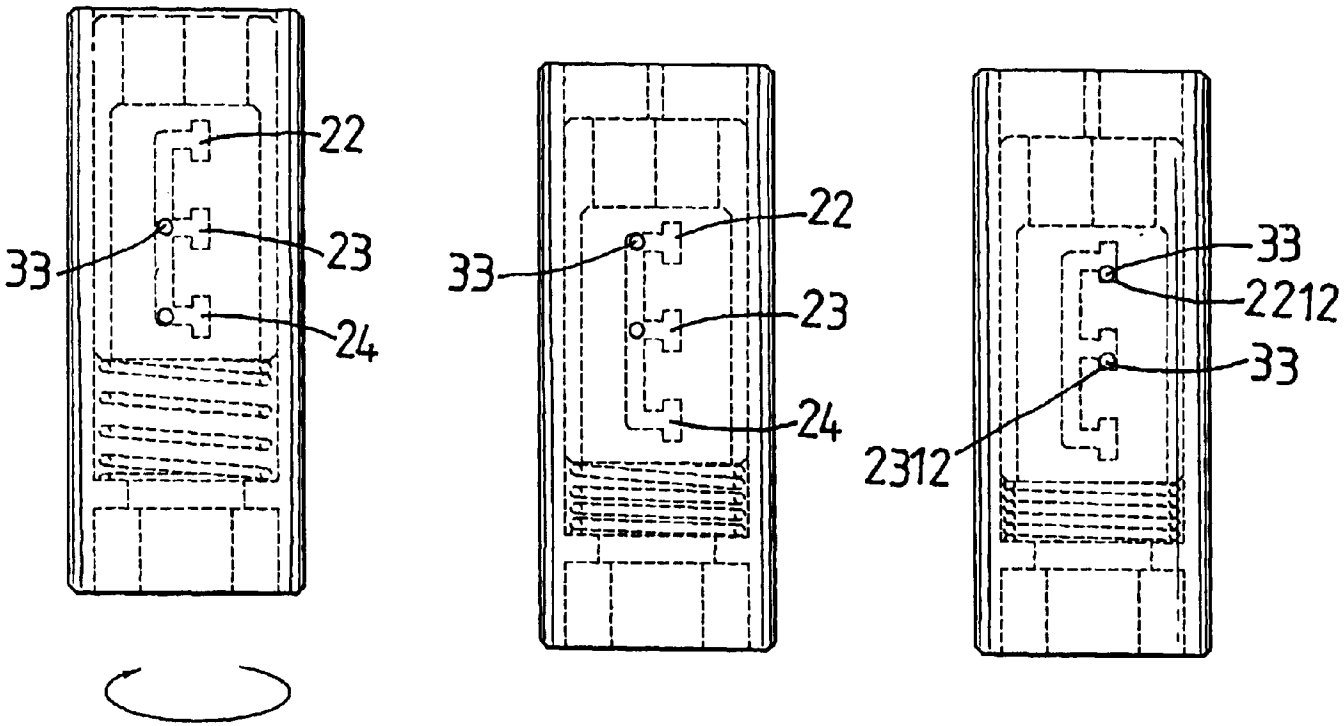
FIG. 4B is a schematic operational view of the telescopic socket assembly as shown in FIG. 4A.
FIG. 4C is a schematic operational view of the telescopic socket assembly as shown in FIG. 4B.
FIG. 4D is a schematic operational view of the telescopic socket assembly as shown in FIG. 4C.

Then, the inner socket 20 is rotated relative to the outer socket 30, so that the two fixing pins 33 of the outer socket 30 are relatively moved into the guide slot 26 of the adjusting hole 21 of the inner socket 20 as shown in FIG. 4B.

Then, the inner socket 20 is further pressed downward to move from the position as shown in FIG. 4B to the position as shown in FIG. 4C, so that the two fixing pins 33 of the outer socket 30 align with the first positioning slot 22 and the second positioning slot 23.

Then, the inner socket 20 is rotated relative to the outer socket 30, so that the two fixing pins 33 of the outer socket 30 are moved into the first positioning slot 22 and the second positioning slot 23.

Then, the pressing force applied on the inner socket 20 is removed, so that the two fixing pins 33 of the outer socket 30 are moved into and rested on the lower end 2212 of the first positioning slot 221 and the lower end 2312 of the second positioning slot 23 by the restoring force of the elastic member 40 as shown in FIG. 4D, thereby fully retracting the inner socket 20 into the outer socket 30.

Figure 3:
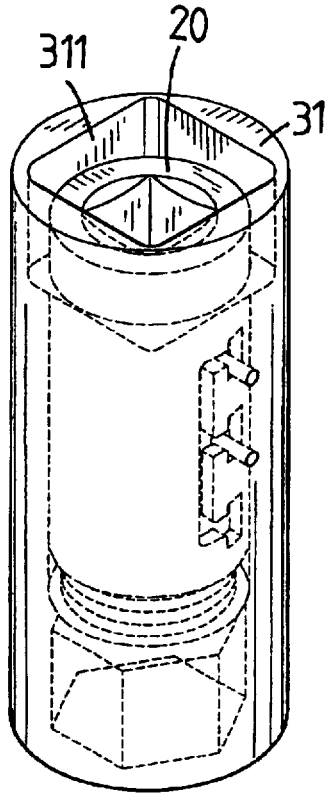
FIG. 3 is a schematic operational view of the telescopic socket assembly as shown in FIG. 2 in use.

Thus, when the two fixing pins 33 of the outer socket 30 are mounted in the second positioning slot 23 and the third positioning slot 24 of the adjusting hole 21 of the inner socket 20 as shown in FIG. 4, the inner socket 20 is protruded outward from the outer socket 30 as shown in FIG. 2. Alternatively, when the two fixing pins 33 of the outer socket 30 are mounted in the first positioning slot 22 and the second positioning slot 23 as shown in FIG. 4D, the inner socket 20 is fully retracted into the outer socket 30 as shown in FIG. 3. Accordingly, the inner socket 20 has a two-stage position adjustment function.

Figure 5:
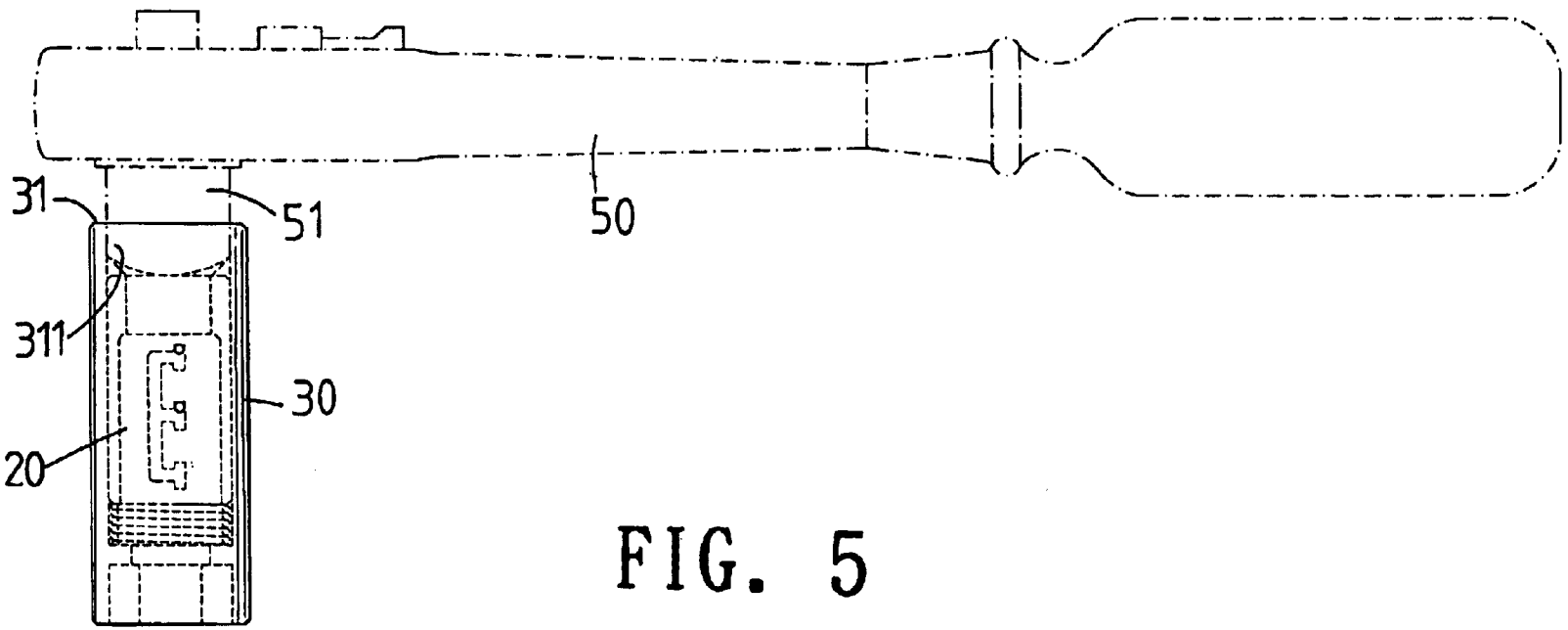
FIG. 5 is a schematic operational view of the telescopic socket assembly as shown in FIG. 4D.

Referring to FIGS. 3 and 5, the inner socket 20 is fully retracted into the outer socket 30, thereby exposing the square fixing hole 311 of the first end 31 of the outer socket 30 to receive a square driving stud 51 of a wrench 50, so that the telescopic socket assembly of the present invention can cooperate with the driving stud 51 having a larger diameter.

Figure 6:
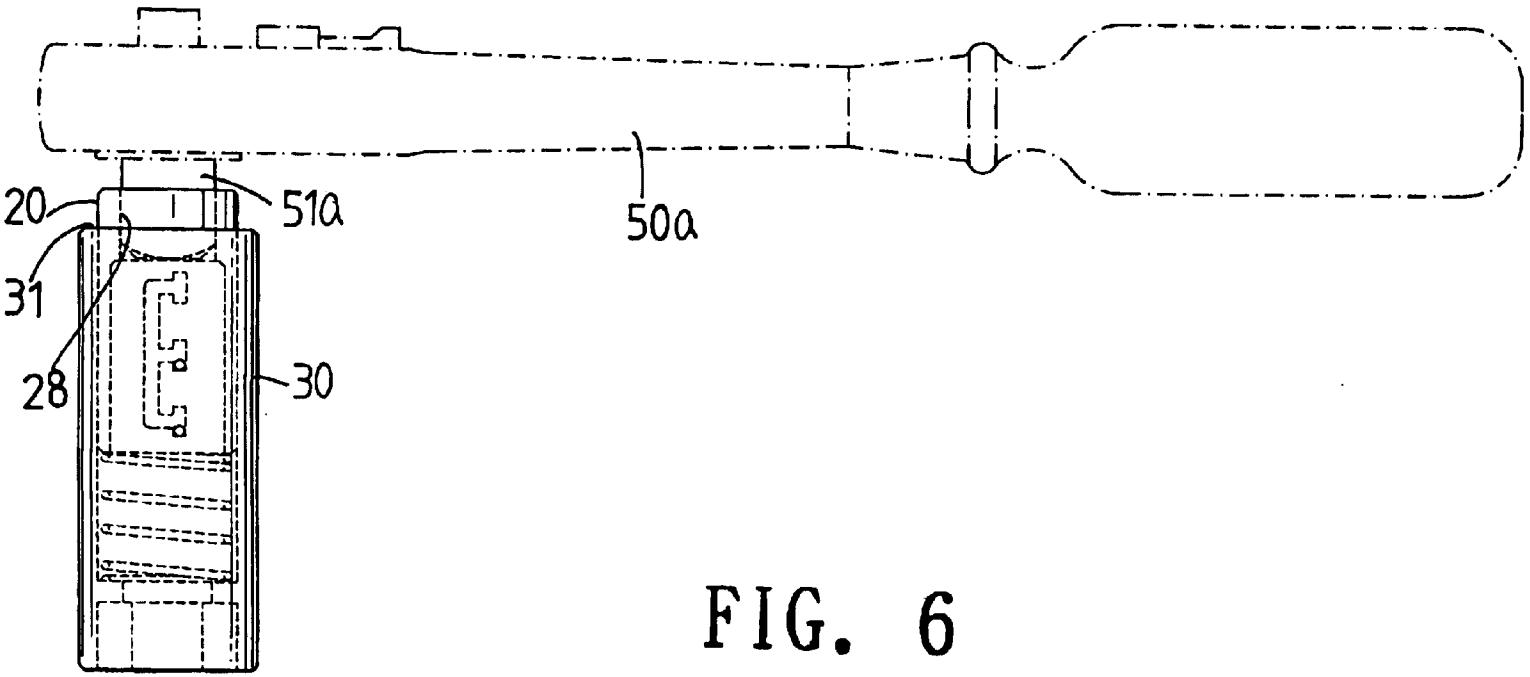
FIG. 6 is a schematic operational view of the telescopic socket assembly as shown in FIG. 4.
Figure 7:
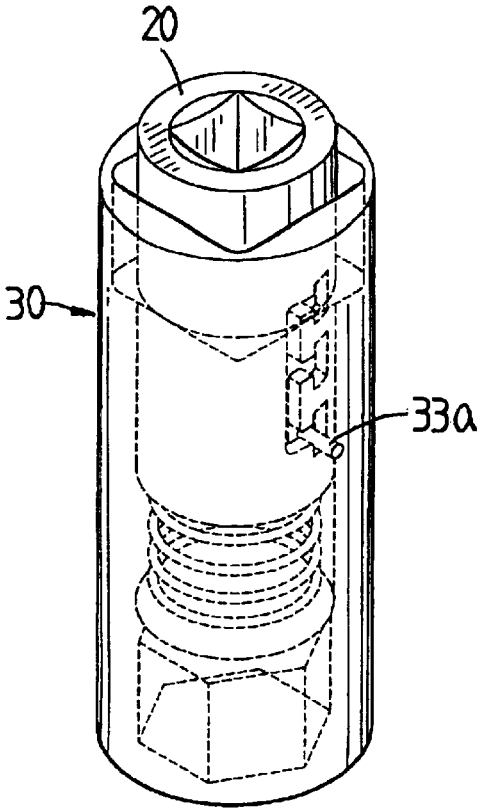
FIG. 7 is a perspective assembly view of a telescopic socket assembly in accordance with another embodiment of the present invention.
Figure 8:
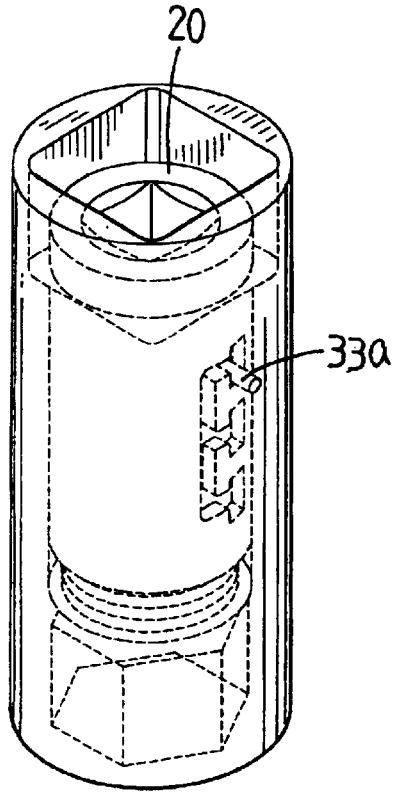
FIG. 8 is a schematic operational view of the telescopic socket assembly as shown in FIG. 7 in use.
Figure 9:
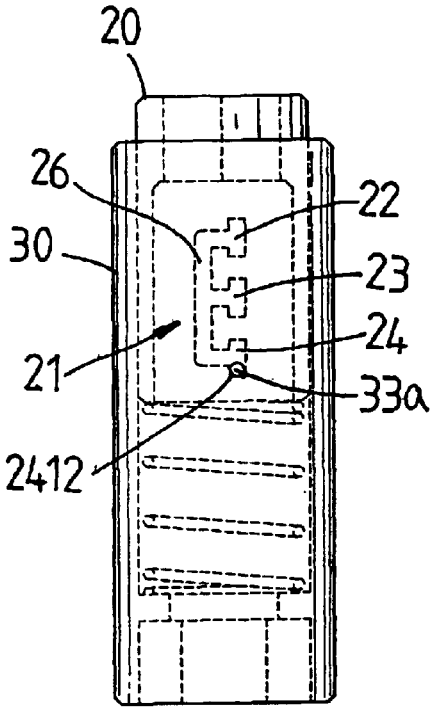
FIG. 9 is a plan view of the telescopic socket assembly as shown in FIG. 7.
Figure 10:
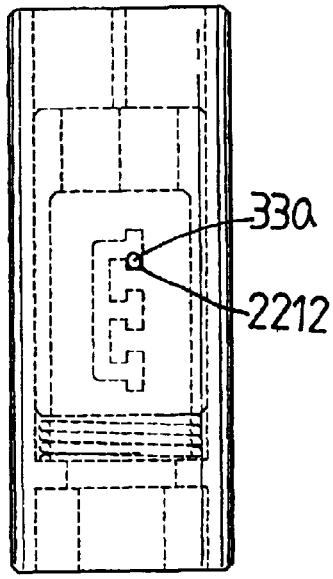
FIG. 10 is a plan view of the telescopic socket assembly as shown in FIG. 8.

Referring to FIGS. 2 and 6, the inner socket 20 is protruded outward from the outer socket 30, thereby exposing the square fixing hole 28 of the first end of the inner socket 20 to receive a square driving stud 51*a* of a wrench 50*a*, so that the telescopic socket assembly of the present invention can cooperate with the driving stud 51*a* having a smaller diameter. In addition, when the inner socket 20 is protruded outward from the outer socket 30, the length of the telescopic socket assembly is increased, so that the telescopic socket assembly can be used to operate a workpiece at a deeper position.

Referring to FIGS. 7–10, a telescopic socket assembly in accordance with another embodiment of the present invention is shown, wherein the outer socket 30 only includes a fixing pin 33*a* which is movably mounted in the adjusting hole 21 of the inner socket 20 and is movable between the first positioning slot 22, the second positioning slot 23 and the third positioning slot 24, so that the inner socket 20 has a three-stage position adjustment function.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A telescopic socket assembly, comprising:

an outer socket;

an inner socket retractably and movably mounted in the outer socket; and an elastic member mounted between the inner socket and the outer socket;

wherein the inner socket has a peripheral wall formed with an adjusting hole, and the adjusting hole of the inner socket includes a longitudinally extended guide slot, a first positioning slot communicating with the guide slot, a second positioning slot communicating with the guide slot, and a third positioning slot communicating with the guide slot.

2. The telescopic socket assembly in accordance with claim 1, wherein the adjusting hole of the inner socket is substantially E-shaped.

3. The telescopic socket assembly in accordance with claim 1, wherein the first positioning slot of the adjusting hole of the inner socket is substantially T-shaped.

4. The telescopic socket assembly in accordance with claim 1, wherein the first positioning slot of the adjusting hole of the inner socket has an upper end, a lower end, and a mediate portion connected to the upper end and the lower end and communicating with the guide slot.

5. The telescopic socket assembly in accordance with claim 1, wherein the second positioning slot of the adjusting hole of the inner socket is substantially T-shaped.

6. The telescopic socket assembly in accordance with claim 1, wherein the second positioning slot of the adjusting hole of the inner socket has an upper end, a lower end, and a mediate portion connected to the upper end and the lower end and communicating with the guide slot.

7. The telescopic socket assembly in accordance with claim 1, wherein the third positioning slot of the adjusting hole of the inner socket is substantially T-shaped.

8. The telescopic socket assembly in accordance with claim 1, wherein the third positioning slot of the adjusting hole of the inner socket has an upper end, a lower end, and a mediate portion connected to the upper end and the lower end and communicating with the guide slot.

9. The telescopic socket assembly in accordance with claim 1, wherein the outer socket has a peripheral wall provided with two spaced fixing pins mounted in the adjusting hole of the inner socket, so that when the inner socket is moved in the outer socket, the two spaced fixing pins of the outer socket are moved in the adjusting hole of the inner socket relatively.

10. The telescopic socket assembly in accordance with claim 9, wherein the two fixing pins of the outer socket are movably mounted in the guide slot of the adjusting hole of the inner socket and are positionable in either two of the first positioning slot and the second positioning slot or in the second positioning slot and the third positioning slot of the adjusting hole of the inner socket.

11. The telescopic socket assembly in accordance with claim 1, wherein the outer socket has a peripheral wall provided with a fixing pin mounted in the adjusting hole of the inner socket, so that when the inner socket is moved in the outer socket, the fixing pin of the outer socket is moved in the adjusting hole of the inner socket relatively.

12. The telescopic socket assembly in accordance with claim 11, wherein the fixing pin of the outer socket is movably mounted in the guide slot of the adjusting hole of the inner socket and is positioned in either one of the first positioning slot, the second positioning slot and the third positioning slot of the adjusting hole of the inner socket.

13. The telescopic socket assembly in accordance with claim 1, wherein the outer socket has a first end formed with a square fixing hole, a second end formed with a hexagonal locking hole and a mediate portion formed with a cylindrical receiving hole.

14. The telescopic socket assembly in accordance with claim 13, wherein the inner socket is slidably mounted in the receiving hole of the outer socket and has a first end formed with a square fixing hole.

15. The telescopic socket assembly in accordance with claim 13, wherein the portion of the outer socket is provided with a shoulder located adjacent to the second end of the outer socket, and the elastic member is mounted in the receiving hole of the outer socket and has a first end urged on a second end of the inner socket and a second end urged on the shoulder of the outer socket.

16. The telescopic socket assembly in accordance with claim 1, wherein the adjusting hole communicates with an inside of the inner socket.

* * * * *